US005993246A

United States Patent [19]

Moldenhauer et al.

[11] Patent Number: 5,993,246

[45] Date of Patent: Nov. 30, 1999

[54] BREAKAWAY COUPLER AND WASHER FOR ELECTRICAL CONNECTORS

[75] Inventors: David William Moldenhauer, Goldsboro; Steven Jeffrey Measley, La Grange, both of N.C.

[73] Assignee: Cooper Industries, Inc., Houston, Tex.

[21] Appl. No.: 09/063,379

[22] Filed: Apr. 21, 1998

[51] Int. Cl.[6] ..... H01R 13/58

[52] U.S. Cl. ..... 439/474; 439/923

[58] Field of Search ..... 439/180, 152, 439/296, 314, 474, 475, 923, 320

[56] References Cited

U.S. PATENT DOCUMENTS

| | | | |
|---|---|---|---|
| 2,002,177 | 5/1935 | Hastings . | |
| 3,513,436 | 5/1970 | Nodfelt | 439/374 |
| 3,933,404 | 1/1976 | Oehlerking et al. . | |
| 4,077,690 | 3/1978 | Koether | 439/474 |
| 4,166,664 | 9/1979 | Herrmann, Jr. . | |
| 4,707,046 | 11/1987 | Strand | 439/314 |
| 4,872,471 | 10/1989 | Schneider | 137/68.1 |
| 4,909,761 | 3/1990 | Muguira | 439/622 |
| 5,427,542 | 6/1995 | Gerow | 439/314 |
| 5,713,752 | 2/1998 | Leong et al. | 439/358 |

*Primary Examiner*—Khiem Nguyen
*Assistant Examiner*—Michael C. Farrels
*Attorney, Agent, or Firm*—Fish & Richardson P.C.

[57] ABSTRACT

A coupler for connecting a first element to a second element includes a first connector piece securable to the first element; a second connector piece for attaching to the first connector piece; and a flexible breakaway device mounted on the second element for releasably securing the second connector piece to the second element. A method of connecting and disconnecting a first element and a second element includes the steps of providing a first connector piece on the first element; attaching a breakaway device to the second element; attaching a second connector piece to the breakaway device that is attached to the second element; securing the first connector to the second connector; releasing the second connector piece from the second element by deflecting a portion of the breakaway device when a separation force is applied between the first and second elements.

17 Claims, 2 Drawing Sheets

FIG. 6
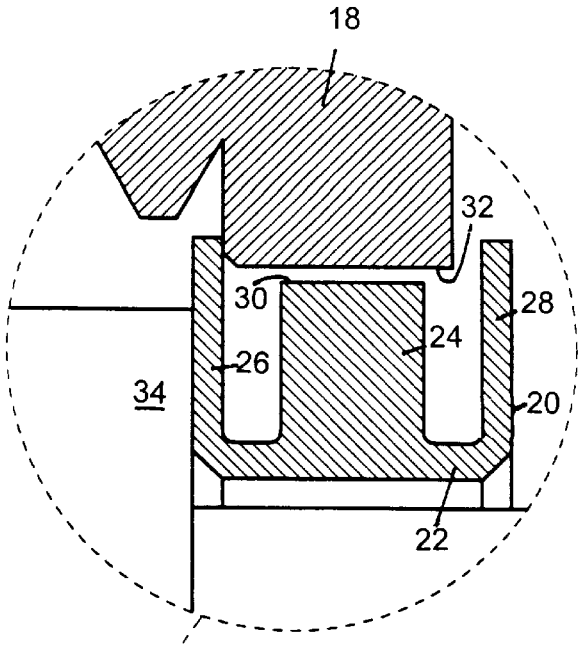
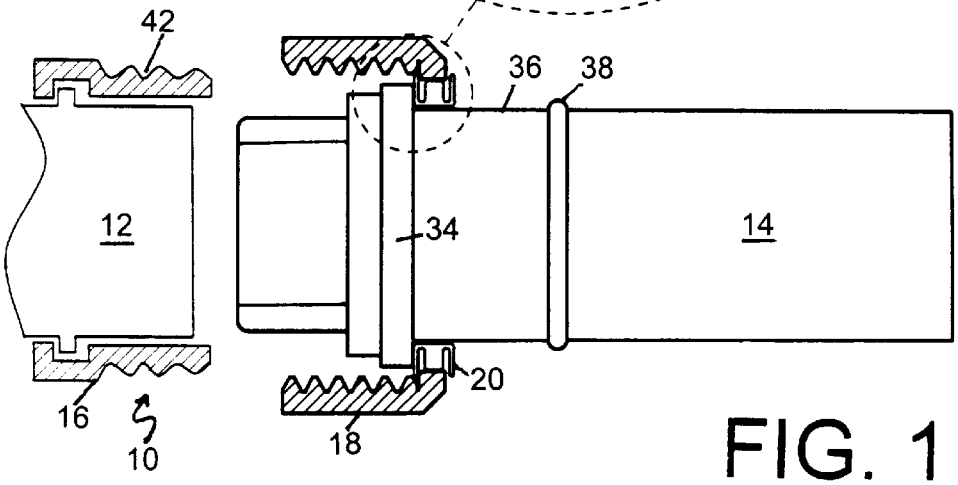
FIG. 1
FIG. 7
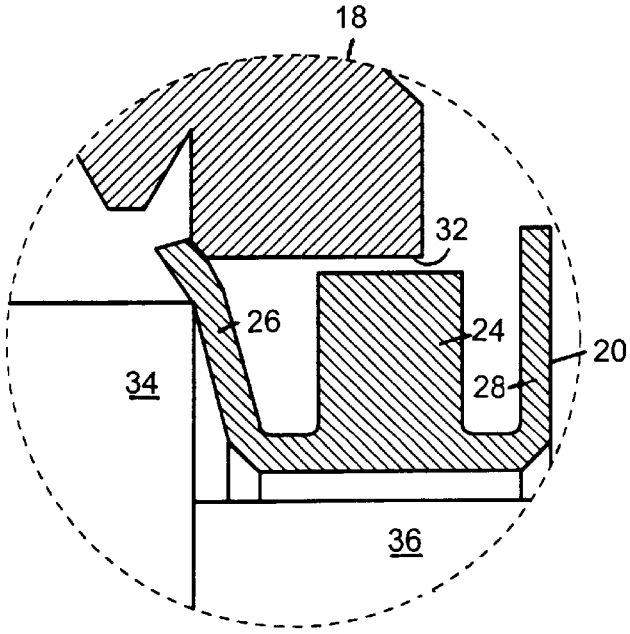

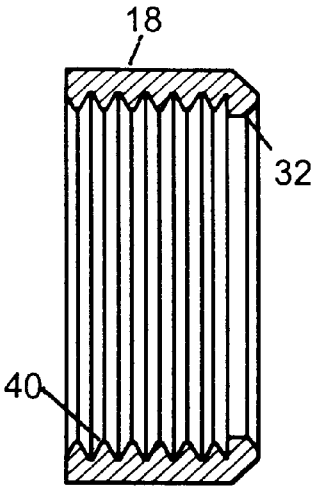
FIG. 2
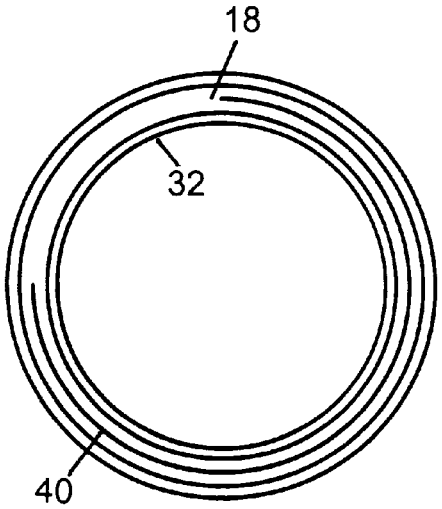
FIG. 3
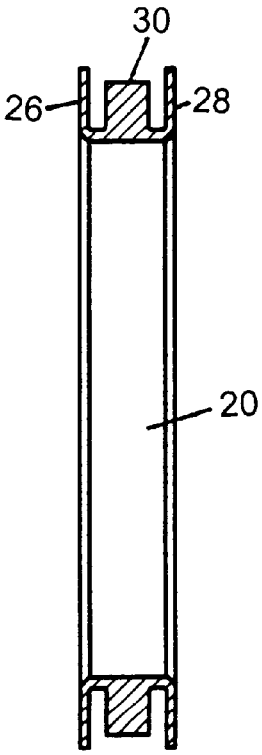
FIG. 4
FIG. 5
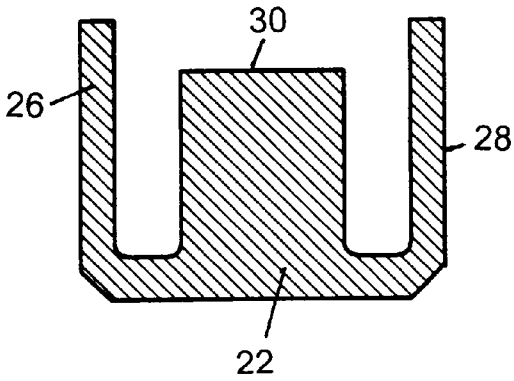

BREAKAWAY COUPLER AND WASHER FOR ELECTRICAL CONNECTORS

BACKGROUND OF THE INVENTION

1. Field of the Invention

The present invention relates to an electrical connector, and in particular, an electrical connector having a breakaway device that enables separation of the connector if the connector is subjected to a predetermined force.

2. Related Art

Breakaway devices have been used with electrical connectors to allow the connectors to be separated if a force exceeding a predetermined level is applied to the connector. The purpose of the breakaway device is to provide a safety means, whereby a force capable of pulling equipment connected to the cable, will be e prevented from doing so. Should equipment be subjected to a pull force above the breakaway limit, it may fall over, fall from a rack, or otherwise fall in such a way to cause personal injury. Another purpose of the breakaway device is to enable the connector to separate at a force smaller than that which is capable of damaging the wires connected by the connector. If the breakaway device did not enable separation of the connector, the wires or devices that are connected by the connector may be damaged.

U.S. Pat. No. 5,427,542 discloses a breakaway connector having a ring shaped retainer 52 that fits within adjacent grooves 54, 56 to enable a main part 16 to be connected to a coupling nut 24. However, this breakaway connector does not include any type of screw connector, and thus does not have the advantages of a screw connector.

U.S. Pat. No. 4,909,761 discloses an in-line breakaway fuse holder. The device disclosed therein is not necessarily an electrical connector, but is a device for holding a fuse. The device includes a first part 72 having a plurality of fingers 82 extending therefrom for engaging with a first body 12. The nut 72 threadably engages with an externally threaded nut 128 which is fixed to a second half of the fuse holder. The plurality of fingers 80 engage a surface 90, which allows separation of the nut 72 from the main body 12 when experiencing an excessive force.

However, the arrangement disclosed in U.S. Pat. No. 4,909,761 includes a number of elements, and is not simple and convenient to manufacture.

OBJECTS AND SUMMARY

It is an object of the present invention to provide a breakaway electrical connector that is both simple to manufacture and use.

It is a further object of the present invention to provide a simple breakaway device that includes a screw coupler.

A coupler for connecting a first element to a second element according to the present invention comprises a first connector piece securable to the first element; a second connector piece for attaching to the first connector piece; and a flexible breakaway device mounted on the second element for releasably securing the second connector piece to the second element.

A method of connecting and disconnecting a first element and a second element according to the present invention comprises the steps of providing a first connector piece on the first element; attaching a breakaway device to the second element; attaching a second connector piece to the breakaway device that is attached to the second element; securing the first connector to the second connector; releasing the second connector piece from the second element by deflecting a portion of the breakaway device when a separation force is applied between the first and second elements.

BRIEF DESCRIPTION OF THE DRAWINGS

FIG. 1 is a view of the breakaway device of the present invention;

FIG. 2 is a cross-sectional view of an internally threaded nut for use with the present invention;

FIG. 3 is an end view of the nut of FIG. 2;

FIG. 4 is a cross-sectional view of a flexible washer used on the present invention;

FIG. 5 is a close-up of the washer of FIG. 4;

FIG. 6 is an enlarged view of a portion of FIG. 1; and

FIG. 7 is the same as FIG. 6, except showing the breakaway device in use.

DETAILED DESCRIPTION OF THE PREFERRED EMBODIMENTS

FIG. 1 shows a breakaway coupler 10 of the present invention used to connect a first wire or element 12 to a second wire or element 14. In one embodiment, the breakaway coupler includes an externally threaded nut 16, an internally threaded nut 18 that is arranged to engage with the nut 16, and a breakaway washer 20 that is used to secure the internally threaded nut 18 to the second wire or element 14.

FIG. 6 is an enlarged cross-sectional view of the internally threaded nut 18. The nut 18 includes internal threads 40 and an inwardly extending flange 32 at one end thereof. The inner diameter of the flange 32 is large enough so that the nut 18 can pass or slide over a flange 34 projecting from the wire 14.

To secure the nut 18 to the second element or wire 14, a flexible washer 20 is provided. See FIGS. 4–7. The washer 20 includes a base region 22 that has an inner diameter large enough so that the washer 20 can slide freely over a flat section 36 of the second element or wire 14. The washer 20 includes a center section 24 for stability and a first flange 26 and a second flange 28 at each end thereof. An outer edge 30 of the center section 24 of the washer 20 has an outer diameter that is small enough so that it does not interfere with the flange 32 of the internally threaded nut 18. The inner diameter of the washer 20 is small enough so that the washer 20 cannot pass over the flange 34 of the second element or wire 14.

To secure the nut 18 on the second wire 14, the flange 32 of the nut 18 is placed between the inner and outer flanges 26, 28 of the washer 20, as can be seen in FIG. 6. This can be done by forcing the nut 18 over the flange 26, which is relatively flexible.

In a preferred embodiment, the washer 20 can be made out of nylon, or any other material having an appropriate level of flexibility. In this preferred embodiment, the inner diameter of the washer 20 is 0.635 inches, and an outer diameter of the base 22 is 0.66inches in diameter. The outermost diameter of the flanges 26, 28 of the washer 20 is 0.8 inches and the outermost diameter of the edge 30 of the washer 20 is 0.770 inches. A thickness of each of the flanges 26, 28 is 0.010±0.001 inches. The gap between the center section 24 and each of the flanges 26, 28 is 0.020 inches. The overall width of the washer from the far side of flange 26 to the far side of the flange 28 is 0.108 inches.

The foregoing dimensions apply only to a particular preferred embodiment of the present invention. The present invention is by no means limited to the specific preferred embodiment disclosed herein.

The inner radius of flange 32 of the internally threaded nut 18 is 0.78 inches. The outer diameter of the internally threaded nut 18 is 1.0 inches. The externally threaded nut 16 and the internally threaded nut 18 are made of aluminum in the preferred embodiment. However, the nuts 16, 18 may be made of other materials known to those of skill in the art.

After the internally threaded nut 18 is secured on the washer 20, as illustrated in FIGS. 1 and 6, the internally threaded nut 18 is threaded onto the externally threaded nut 16. Typically, the second element or wire 14 is first plugged into the first element or wire 12. After the wires 12, 14 are pushed in together, the nuts 16, 18 are threaded together until a tightening resistance is felt. The internally threaded nut 18 is then turned an additional ⅓ of a turn. At this position, there should be slight gap between the other flange 28 of the washer 20 and the flange 32 of the internally threaded nut 18. The gap may be approximately 1/32 of an inch.

Turning attention now to FIG. 7, if a force exceeding a predetermined level is exerted on the wires 12, 14 in order to separate the wires, the inner flange 26 of the washer will be deflected by the flange 32 of the nut 18. If the separation force exceeds a predetermined level, the flange 26 of the washer 20 will deform to such an extent that the nut 18 will be released from the washer 20, and thus the second element or wire 14 can be pulled from out of the nut 18, thus enabling separation of the wires 12, 14 if a force is exerted on the wires that is of a sufficient level in order to cause damage to the wires.

Another advantage of the present invention is that the device 10 may be reused even if it has been separated by the application of a predetermined force.

In the embodiment described herein, the washer 20 is intended to yield and allow separation of the internal nut 18 if a separation force of 30 to 40 pounds is exerted on the wires 12, 14. However, the parameters may be changed by adjusting the size, shape, or materials of the various elements. Specifically, by making the flange 26 of the washer 20 thicker or thinner, the breakaway force may be reduced or increased.

Although the preferred embodiment is disclosed as having the washer 20 on the wire element 14, alternative embodiments may be contemplated. Specifically, a washer type device may be located on the nut 18 having flanges extending inwardly which embrace a flange on the wire 14. Other alternative embodiments may have different yielding elements. Instead of the flexible flange 26, flexible or frangible fingers or other elements may extend outwardly from the washer base 22 toward the internally threaded nut 18.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A coupler for connecting a first element to a second element, the coupler comprising:

a first connector piece securable to the first element;

a second connector piece for attaching to the first connector piece; and a flexible breakaway device mounted on the second element for releasably securing the second connector piece to the second element.

2. The coupler of claim 1, wherein the first and second connector pieces are threadably connectable to each other.

3. The coupler of claim 2, wherein the first and second connector pieces are rigid.

4. The coupler of claim 1, wherein the breakaway device includes a ring portion and a flexible portion extending radially from the ring portion.

5. The coupler of claim 4, wherein the second connector piece includes a flange for engaging the flexible portion of the breakaway device.

6. The coupler of claim 1, wherein the breakaway device is permanently mounted to the second element.

7. The coupler of claim 1, wherein the breakaway device is permanently mounted to the second connector.

8. A coupler for connecting a first element to a second element, the coupler comprising:

a first connector piece securable to the first element;

a second connector piece for attaching to the first connector piece; and a breakaway device slidably mounted on the second element, wherein the second connector is releasably secured to the breakaway device.

9. The coupler of claim 8, wherein the first and second connector pieces are threadably connectable to each other.

10. The coupler of claim 8, wherein the breakaway device is flexible.

11. The coupler of claim 10, wherein the first and second connector pieces are rigid.

12. The coupler of claim 8, wherein the breakaway device includes a ring portion and a flexible portion extending radially from the ring portion.

13. The coupler of claim 12, wherein the second connector piece includes a flange for engaging the flexible portion of the breakaway device.

14. A coupler for connecting a first element to a second element, the coupler comprising:

a first connector piece securable to the first element;

a second connector piece securable to the first connector piece;

a breakaway device slidably secured to the second element, the breakaway device including a portion that engages the second connector and which disengages the second connector when a predetermined separation force is applied between the breakaway device and the second connector.

15. The coupler of claim 14, wherein the first and second connector pieces are threadably connectable to each other.

16. The coupler of claim 14, wherein the breakaway device includes a ring portion and a flexible portion extending radially from the ring portion.

17. A method of connecting and disconnecting a first element and a second element, comprising the steps of:

providing a first connector piece on the first element;

attaching a breakaway device to the second element;

attaching a second connector piece to the breakaway device that is attached to the second element;

securing the first connector to the second connector;

releasing the second connector piece from the second element by deflecting a portion of the breakaway device when a separation force is applied between the first and second elements.

* * * * *